US009127569B2

(12) United States Patent
Akiyama et al.

(10) Patent No.: US 9,127,569 B2
(45) Date of Patent: Sep. 8, 2015

(54) SHROUD STRUCTURE FOR GAS TURBINE

(75) Inventors: Ryou Akiyama, Hitachinaka (JP); Yasuo Takahashi, Mito (JP); Tetsuro Morisaki, Mito (JP); Yasuhiro Horiuchi, Hitachinaka (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 944 days.

(21) Appl. No.: 13/197,818

(22) Filed: Aug. 4, 2011

(65) Prior Publication Data

US 2012/0076650 A1 Mar. 29, 2012

(30) Foreign Application Priority Data

Sep. 28, 2010 (JP) ..... 2010-216463

(51) Int. Cl.

| | |
|---|---|
| ***F01D 25/14*** | (2006.01) |
| ***F01D 25/24*** | (2006.01) |
| ***F01D 11/24*** | (2006.01) |

(52) U.S. Cl.

CPC ..... *F01D 25/246* (2013.01); *F01D 11/24* (2013.01); *F01D 25/14* (2013.01); *F05D 2240/11* (2013.01)

(58) Field of Classification Search

CPC ..... F01D 11/24; F01D 11/08; F01D 25/14; F01D 25/246; F05D 2240/11

See application file for complete search history.

(56) References Cited

U.S. PATENT DOCUMENTS

| | | | | |
|---|---|---|---|---|
| 4,650,394 | A | 3/1987 | Weidner | |
| 7,207,771 | B2 * | 4/2007 | Synnott et al. | 415/173.1 |
| 7,527,472 | B2 * | 5/2009 | Allen | 415/139 |
| 2004/0120808 | A1 * | 6/2004 | Alford et al. | 415/173.1 |

FOREIGN PATENT DOCUMENTS

| | | | |
|---|---|---|---|
| JP | 61-118506 | A | 6/1986 |

* cited by examiner

*Primary Examiner* — Nathaniel Wiehe
*Assistant Examiner* — Jeffrey A Brownson
(74) *Attorney, Agent, or Firm* — Crowell & Moring LLP

(57) ABSTRACT

There is provided a shroud structure for gas turbines capable of suppressing a drop in the amount of cooling air for cooling the inner shroud by reducing the amount of cooling air leakage that occurs along the cooling air path when feeding cooling air from the one-piece outer shroud to the inner shroud of the gas turbine and ensure more reliable cooling of the inner shroud. The gas turbine shroud structure contains a one-piece outer shroud, and an inner shroud retained on the inner circumferential side of the outer shroud in a structure divided into multiple inner shrouds along the periphery. An inner seal plate groove is formed on the outer circumference of the hook formed on the inner shroud, a seal plate is inserted in the inner seal plate groove, and the seal plate is mounted so that a section of the seal plate protrudes in the gap between the hook mechanism of the outer shroud and the inner shroud.

2 Claims, 9 Drawing Sheets

SHROUD STRUCTURE FOR GAS TURBINE

FIELD OF THE INVENTION

The present invention relates to a shroud structure for gas turbines comprised of an inner shroud and an outer shroud on the turbine section of the gas turbine.

BACKGROUND OF THE. INVENTION

In gas turbines, the cooling air for cooling the interior of the shroud retained by a casing, flows into the shroud inserted between the casing and turbine gas path section to insulate the casing from heat in the gas path section that causes high temperatures.

The technology disclosed in a publicly known example of Japanese Unexamined Patent Application Publication No. Sho61 (1986)-118506 describes a gas turbine shroud structure comprised of a segmented type outer shroud installed on a casing segmented horizontally into two pieces, and an inner shroud facing the gas turbine section held on the inner circumferential side of the segmented type outer shroud. This structure is configured so that the cooling air to cool the inner shroud passes along the outer shroud and is guided into the inner shroud.

The technology for the gas turbine shroud structure disclosed in Japanese Unexamined Patent Application Publication No. Sho61(1986)-118506 is a structure as shown in FIG. 2 containing M type cross sectional seal members respectively mounted in the gap between on the side surfaces of the inner shroud, and the side surfaces of each segmented type outer shroud facing the side surfaces of this inner shroud in order to prevent the cooling air from escaping during passage along the cooling air passage.

SUMMARY OF THE INVENTION

However, in the gas turbine shroud structure disclosed in Japanese Unexamined Patent Application Publication No. Sho61(1986)-118506 the segmented outer side shroud is a complicated structure. Attempting to simplify the complicated segmented type outer shroud structure just by forming it as one piece, however, causes the problem that mounting the M type cross sectional seal members in the gap between inner shroud side surfaces and the outer shroud side surface is extremely difficult.

Namely, mounting the M type cross sectional seal member requires assembling the inner shroud into the side surface of the one-piece outer shroud in a state where the M type cross sectional seal member is pressed so as to reach an orientation along the turbine axis on the side surface of the one-piece outer shroud. Mounting an M type cross sectional seal member in the gap between the outer shroud side surfaces and the inner shroud side surfaces is therefore extremely difficult.

The present invention has the object of providing a shroud structure for gas turbines capable of suppressing a drop in the amount of cooling air for cooling the inner shroud by reducing the amount of cooling air leakage that occurs along the cooling air path when feeding cooling air from the one-piece outer shroud to the inner shroud of the gas turbine and therefore ensure more reliable cooling of the inner shroud.

According to one aspect of the present invention, the gas turbine shroud structure includes:

a one-piece outer shroud including a hook retainer groove formed continuously along the periphery on the inner circumferential side; and an inner shroud including a hook formed continuously along the periphery on the outer circumferential side and held on the inner circumferential side of the outer shroud by inserting that hook into a hook retainer groove of the outer shroud, in which, in the gas turbine shroud structure having an inner shroud segmented into plural inner shrouds along the periphery, all of these plural segmented inner shrouds being held in the hook retainer groove of the outer shroud to form a ring-shaped inner shroud, an inner seal plate groove is formed on the outer circumferential side of the hook formed in the inner shroud; a seal plate is inserted into the inner seal plate groove; and a section of the seal plate is mounted so as to protrude in the gap between the hook of the inner shroud and the hook retainer groove of the outer shroud.

According to another aspect of the present invention, the gas turbine shroud structure includes a one-piece outer shroud including a hook retainer groove formed continuously along the periphery on the inner circumferential side; and an inner shroud including a hook formed continuously along the periphery on the outer circumferential side, and held on the inner circumferential side of the outer shroud by inserting this hook into a hook retainer groove of an outer shroud;

in which, in the gas turbine shroud structure including an inner shroud segmented into plural inner shrouds along the periphery, all of these plural segmented inner shrouds being held in the hook retainer groove of the outer shroud to form a ring-shaped inner shroud, a split surface facing the edge of the adjacent inner shrouds is formed on the edges of each inner shroud segmented into plural pieces; a split surface seal plate groove is formed along the applicable split surface on the outer circumferential side of the inner shroud; a seal plate inserted into the split surface seal plate groove is formed; and a section of the seal plate is mounted so as to protrude in the gap between the hook of the inner shroud and the hook retainer groove of the outer shroud.

According to still another aspect of the present invention, the gas turbine shroud structure further includes:

a one-piece outer shroud to feed cooling air into the internal sections, the outer shroud having a hook retainer groove formed continuously along the periphery on the inner circumferential side; and an inner shroud having a hook formed continuously along the periphery on the outer circumferential side and held on the inner circumferential side of the outer shroud by inserting the hook into a hook retainer groove of the outer shroud, and the inner circumferential side of the inner shroud fed with cooling air to the inside that passed by the outer shroud, facing the gas path surfaces, in which, in the gas turbine shroud structure including an inner shroud segmented into plural inner shrouds along the periphery, all of these plural segmented inner shrouds being held in the hook retainer groove of the outer shroud to form a ring-shaped inner shroud, a split surface facing the edge of the adjacent inner shroud is formed on the edges of each inner shroud segmented into plural pieces; a split surface seal plate groove is formed along the applicable split surface on the outer circumferential side of the inner shroud; a seal plate is formed to insert into the split surface seal plate groove; and a section of the seal plate is mounted so as to protrude in the gap between the hook of the inner shroud and the hook retainer groove of the outer shroud.

The present invention therefore renders a shroud structure for gas turbines capable of suppressing a drop in the amount of cooling air for cooling the inner shroud by reducing the amount of cooling air leakage that occurs along the cooling air path when feeding cooling air from the one-piece outer shroud to the inner shroud of the gas turbine and therefore ensures more reliable cooling of the inner shroud.

DETAILED DESCRIPTION OF THE PRESENT EMBODIMENTS

Figure 1:
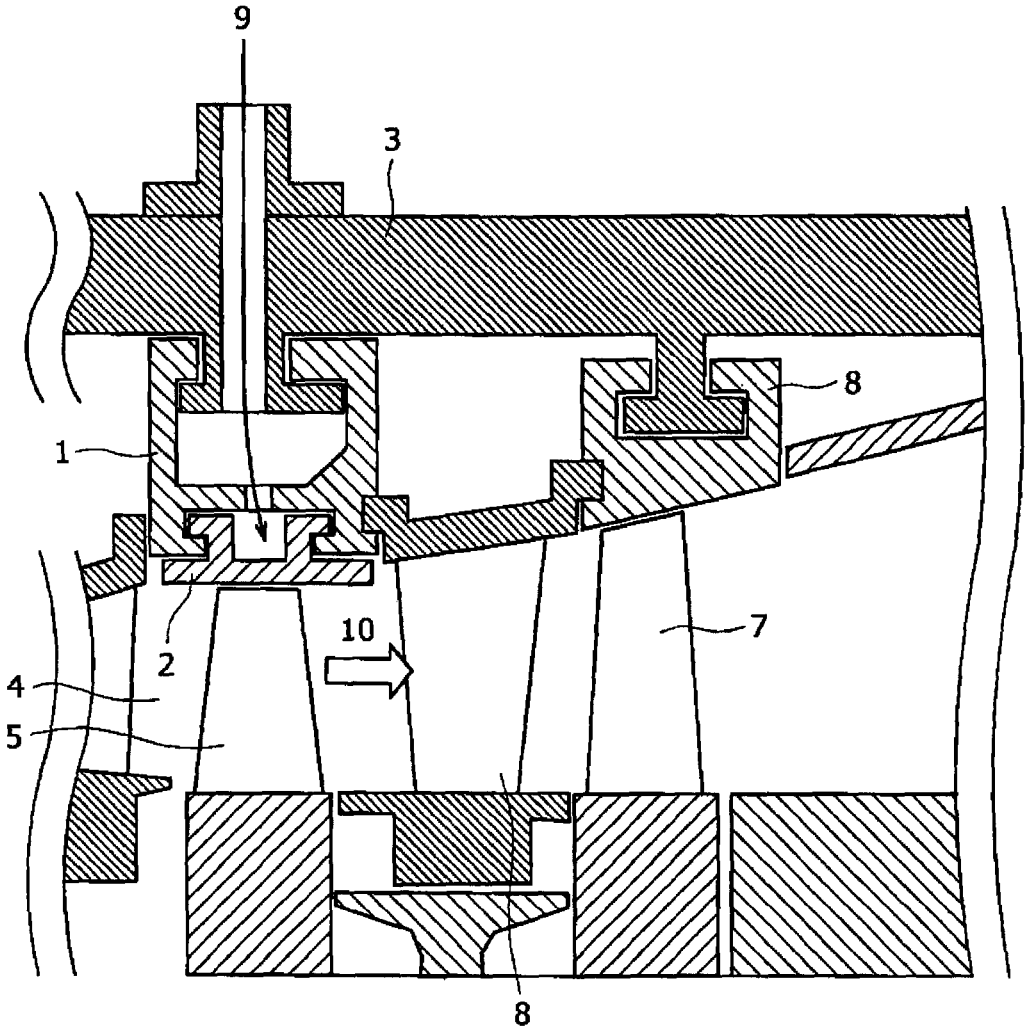
FIG. 1 is a concept structural drawing for the gas turbine utilizing the gas turbine shroud structure of the present invention.

The embodiments of the gas turbine shroud structure of the present invention are described next while referring to the drawings.

First Embodiment

The gas turbine shroud structure of the first embodiment of the present invention is described next while referring to FIG. 1 through FIG. 3.

FIG. 1 is a concept structural drawing for the gas turbine utilizing the gas turbine shroud structure of the first embodiment of the present invention. In the gas turbine shroud structure of the first embodiment in FIG. 1, a first stage stator (or stationary) blade 4 is mounted on the inside of a case 3 of the gas turbine, and a first stage rotor blade 5 is mounted at a position on the downstream side of this first stage stator blade 4. A second stage stator blade 6, and a second stage rotor blade 7 positioned on the downstream side of this second stage stator blade 6 are respectively mounted on the downstream side of these first stage stator blade 4 and first stage rotor blade 5.

The space inside the gas turbine casing 3 where the first stage stator blade 4, the first stage rotor blade 5, the second stage stator blade 6, and the second stage rotor lade 7 are located is called the turbine gas path. An arrow 10 is the flow direction that the working fluid flows in the direction of the turbine axis within the turbine gas path.

A one-piece first stage outer shroud 1 is mounted on the inner circumference of the casing 3 serving as the radial outer circumferential side of the first stage rotor blade 5. A first stage inner shroud 32 is mounted facing the first stage rotor blade 5 on the inner circumferential side of this one-piece first stage outer shroud 1. A second stage shroud 8 is mounted in the same way on the inner circumference of the casing 3 serving as the radial outer circumferential side of the second stage rotor blade 7.

The working fluid flowing within the turbine gas path reaches high temperatures. The farther upstream side of the arrow 10 the higher the temperature. The first stage outer shroud 1, the first stage inner shroud 32 and the second stage shroud 8 are mounted so as to insulate the casing 3 from the high temperature working fluid.

The cooling air 9 from outside the casing 3 enters the one-piece first stage outer shroud 1 and the first stage inner shroud 32, and cools the one-piece first stage outer shroud 1 and the first stage inner shroud 32.

The cooling air 9 fed into the one-piece first stage outer shroud 1 and the first stage inner shroud 32 can be also be applied to cases where using air bled from the compressor of a gas turbine or using compressed air from a compressor installed separately at an external location. The arrow showing leakage of cooling air 9 is omitted from FIG. 1.

In the gas turbine shroud structure of the present embodiment, heat-resistant material capable of withstanding high temperatures is utilized in the first stage inner shroud 32 facing the high temperature turbine gas path, and low-cost material somewhat lacking in heat-resistance is utilized in the one-piece first stage outer shroud 1 mounted on the outer circumferential side along the radius of the first stage inner shroud 32 that is subject to comparatively low temperatures. Costs can therefore be reduced by limiting the usage region of high-cost heat resistant material to the first stage inner shroud 32.

Figure 2:
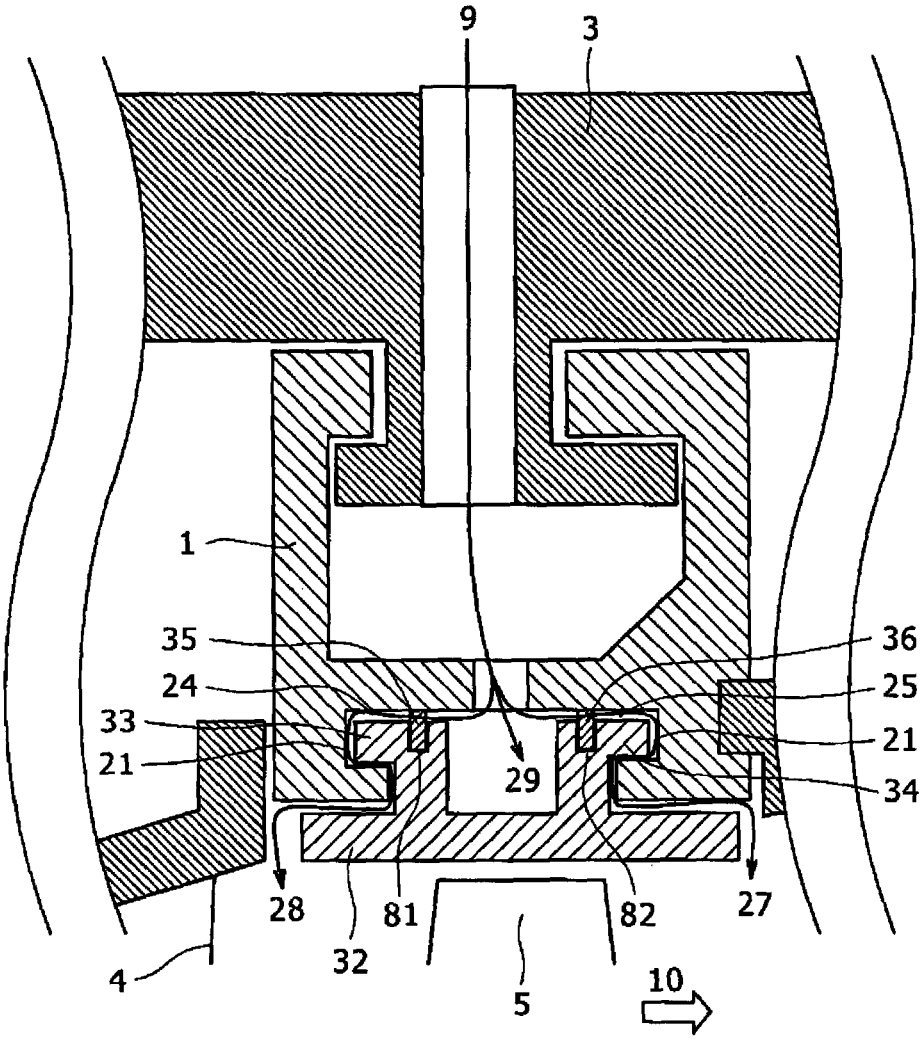
FIG. 2 is a fragmentary view showing the gas turbine shroud structure of the first embodiment of the present invention.

FIG. 2 is an enlarged fragmentary view showing the showing the structure around the periphery of the one-piece first stage outer shroud 1 and the first stage inner shroud 32 in the gas turbine shroud structure of the first embodiment shown in FIG. 1. Also, FIG. 3 is a perspective view showing just the one-piece first stage inner shroud 32 of the gas turbine shroud structure of the first embodiment shown in FIG. 1.

As can be seen in FIG. 2, the hook retainer grooves 21 having a rectangular cross-section open on one side, are respectively formed continuously along the periphery, on both sides of the inner circumferential side of the one-piece first stage outer shroud 1 in the shroud structure of the gas turbine of the first embodiment.

The hooks 33, 34 are respectively formed extending horizontally so as to engage in each of the hook retainer grooves 21 formed on the inner circumferential side of the first stage outer shroud 1 are formed, on the outer side of the first stage inner shroud 32 assembled into the one-piece first stage outer shroud 1.

The first stage inner shroud 2 is segmented in plural pieces along the periphery, and when assembled is the first stage inner shroud 2 forming an entire structure in a ring shape.

Figure 3:
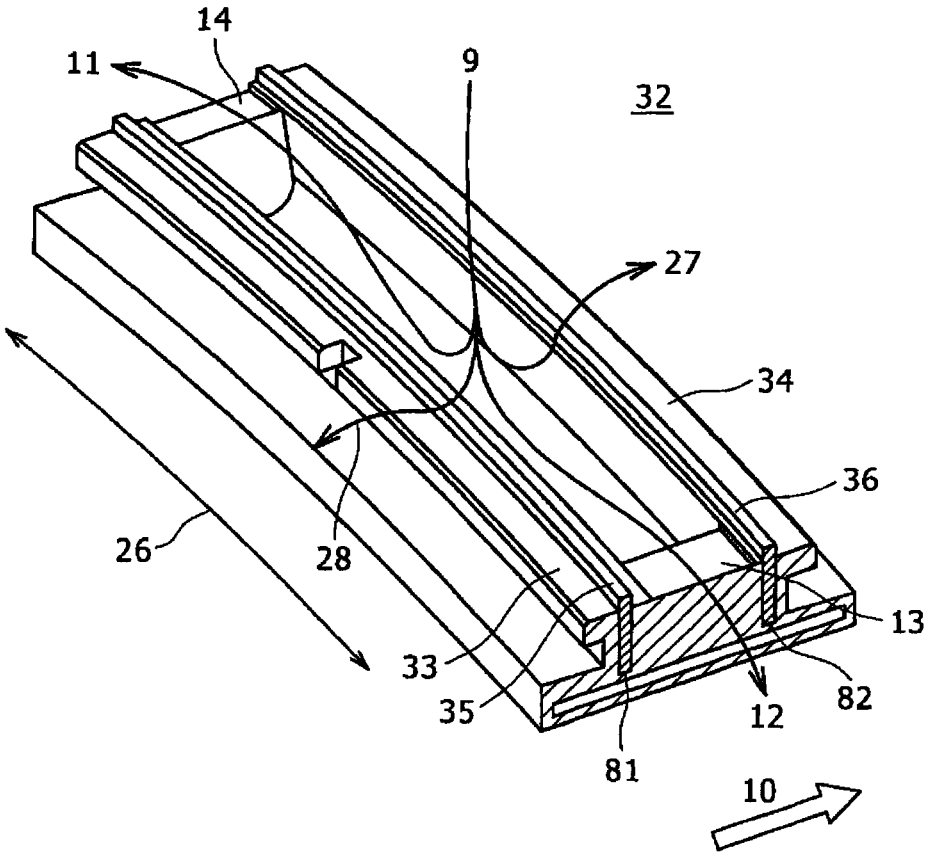
FIG. 3 is a perspective view showing a first stage inner shroud in the gas turbine shroud structure of the first embodiment.

FIG. 3 is a perspective view showing one component of the segmented first stage inner shroud 32. The arrow 10 is the flow direction of the working fluid flowing downstream on the turbine gas path, and the arrow 26 is the circumferential direction. The hooks 33, 34 formed in the first stage inner shroud 32 are formed continuously along the circumference as shown in FIG. 3. This first stage inner shroud 32, and the first stage inner shrouds 32 adjacent in the circumferential direction include the respective split surfaces 13, 14 formed to make mutual contact between them (The adjoining first stage inner shroud is not shown in the drawing in FIG. 3.)

As shown in FIG. 3, the first stage inner shroud 32 is assembled to allow retention by the one-piece first stage outer shroud 1 by inserting the hooks 32, 33 of the first stage inner shroud 32 respectively into each of the hook retainer grooves 21 formed on the inner circumferential sides of the first stage outer shroud 1.

The gaps 24, 25 are respectively present between the hooks 32, 33 of the first stage inner shroud 32, and each hook retainer groove 21 on the inner circumferential side of the first outer shroud 1. The arrows 27, 28 shown in FIG. 2 and FIG. 3 indicate the stage flow directions of the leaking portion of the cooling air 9 supplied by way of the gaps 24, 25 between the respective first stage outer shroud 1 and the first stage inner shroud 32 to the interior of the first stage outer shroud 1. The arrow 29 shown in FIG. 2 indicates the flow of a portion of the cooling air 9 supplied to the interior of first stage outer shroud 1, that flows (leaks) into the space within the first stage inner shroud 32.

The arrows 27, 28 shown in FIG. 3 are the leakage flows 27, 28 of the cooling air 9 shown in FIG. 2. Though not shown in FIG. 2, there are also leakage flows of cooling air 9 along the circumference as shown by the arrows 11, 12 in FIG. 3.

The leakage currents 27, 28, 11, and 12 branch off from the cooling air 9 path so that the volume of cooling air 29 reaching the first stage inner shroud 32 is reduced by an equivalent amount. Therefore, when the cooling of the first stage inner shroud 32 is insufficient, the temperature of the metal rises and heat damage occurs on the first stage inner shroud 1 leading to a possible decline in reliability.

Increasing the flow rate of the cooling air 9 in advance was considered in order to compensate for insufficient cooling of the first stage inner shroud 32 due to cooling air leakage. However in most cases, air bled from the gas turbine compressor or compressed air from a separately installed air compressor was used so increasing the flow of cooling air 9 causes a drop in the gas turbine efficiency.

Multiple grooves serving as the inner seal plate grooves 81, 82 are formed along the periphery on the outer circumferential surface of the hooks 33, 34 of first stage inner shroud 32 as shown in FIG. 2 and FIG. 3.

The seal plates 35, 36 respectively mounted on the outer circumferential side of the hooks 33, 34 of the first stage inner shroud 32, to extend towards the periphery, and are inserted into the interior of these inner seal plate grooves 81, 82.

The outer circumferential side of the seal plates 35, 36 inserted into the inner seal plate grooves 81, 82 of the hooks 33, 34 are mounted so as to protrude from the outer circumference of hooks 33, 34 of first stage inner shroud 32 into the gaps 24, 25 on the radial outer side and in this way function to reduce the leakage currents 27, 28 flow of cooling air 9 into the gaps 24, 25.

In the gas turbine shroud structure of the present embodiment, the seal plates 35, 36 protruding into the gaps 24, 25 suppress the flow of cooling air 9 in the leakage currents 28, 29 that flow through the gaps 24, 25 and can therefore lower the flow rate of the cooling air 9 leakage currents 27, 28. The flow rate of the cooling air 29 that reaches the first stage inner shroud 32 is therefore increased and the temperature of the metal of the first stage inner shroud 32 is therefore lowered by an equivalent amount so that heat damage to the first stage inner shroud 32 is prevented and the reliability of the first stage inner shroud 32 can be improved.

In the gas turbine shroud structure of the present embodiment, the seal plates 35, 36 mounted on the outer circumferential side surface of the hooks 33, 34 of the first stage inner shroud 32 suppress the cooling air 9 leakage flows 27, 28 flowing through the gaps 24, 25 so that the supply of cooling air 29 can be maintained at a fixed quantity, and the amount of cooling air 9 that is supplied can be reduced by an amount equivalent the reduction in the leakage flows 27, 28. In this case, lowering the amount of cooling air 9 that is supplied can improve the gas turbine efficiency.

When the gaps 24, 25 are too narrow during insertion of the hooks 33, 34 of the first stage inner shroud 32 into each of the hook retainer grooves 21 of the first stage outer shroud 1, then the frictional force will make insertion difficult, and (component) assembly may prove troublesome. However, in the gas turbine shroud structure of the present embodiment, the area where the gaps 24, 25 is narrow is limited to the section where the seal plates 35, 36 formed on the outer circumferential side surface of the hooks 33, 34 of first stage inner shroud 32 protrude into the gaps 24, 25 so that an increase in frictional force during insertion of hooks 33, 34 of first stage inner shroud 32 into each of the hook retainer grooves 21 of the first stage outer shroud 1 can be minimized and a worsening of assembly characteristics can be suppressed.

If assembly is difficult due to a large frictional force on the outer circumferential side of the protruding section of the seal plates 35, 36, then the gaps must be widened by machining the outer circumferential sides of the seal plates 35, 36. However, the seal plates 35, 36 in this embodiment are made from thin plate so that machining is easily performed and completed swiftly allowing improved assembly characteristics.

This embodiment of the present invention lowers the amount of cooling air leakage that is lost along the cooling air path during feeding of cooling air into the inner shroud from the one-piece outer shroud of the gas turbine and also suppresses a drop in the amount of cooling air that cools the inner shrouds and therefore achieves a gas turbine shroud structure that definitely provides more reliable cooling of the inner shroud.

Second Embodiment

The second embodiment of the gas turbine shroud structure of the present invention is described next while referring to FIG. 4 and FIG. 5.

The gas turbine shroud structure of this embodiment is largely identical to the gas turbine shroud structure of the first embodiment shown in FIG. 1 through FIG. 3 so descriptions common to both embodiments are omitted and only the sections that differ from the first embodiment are described next.

Figure 4:
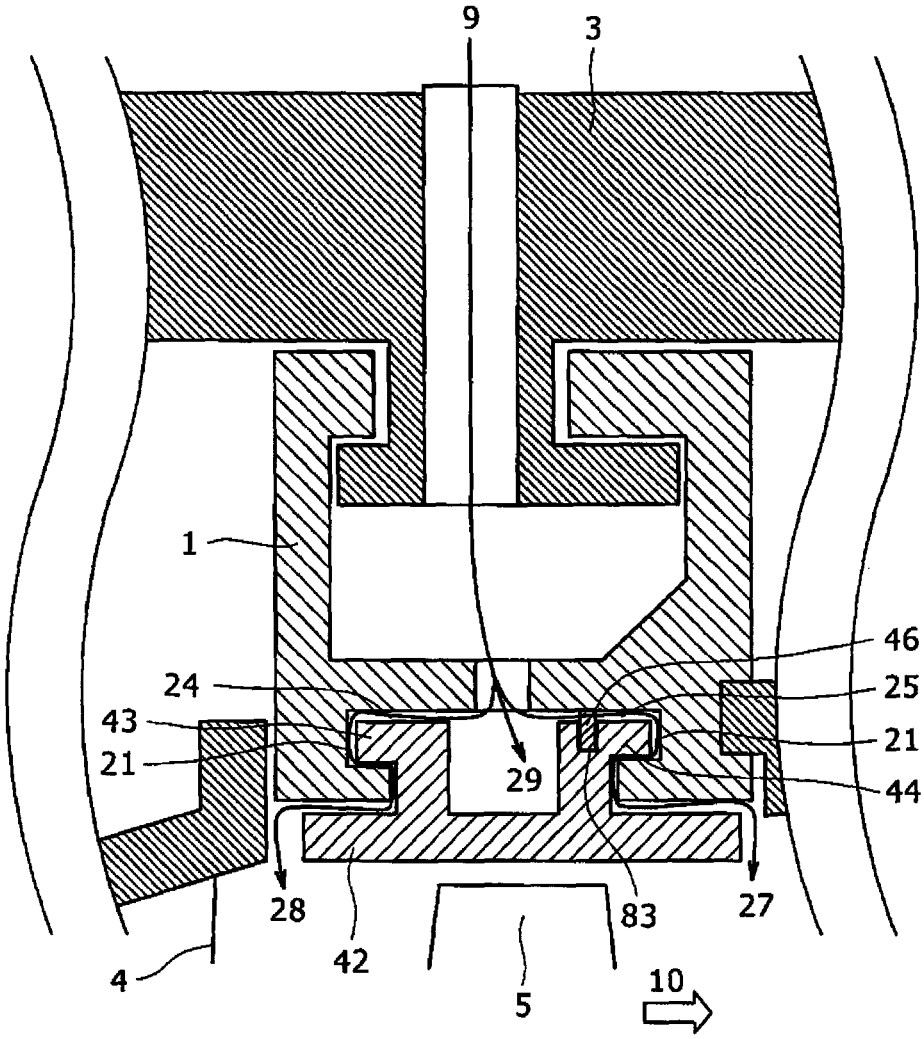
FIG. 4 is a fragmentary view showing the gas turbine shroud structure of a second embodiment of the present invention.

FIG. 4 is an enlarged view showing the periphery of the first stage inner shroud 42, and the one-piece first stage outer shroud 1 in the gas turbine shroud structure of the second embodiment.

On the outer circumferential side of the first stage inner shroud 42 assembled into the one-piece first stage outer shroud 1, the hooks 43, 44 are respectively installed extending horizontally so as to engage with each of the hook retainer grooves 21 formed on the inner circumferential side of the first stage outer shroud 1.

The inner seal plate groove 83 is formed along the periphery the outer circumferential surface of the hooks 44 among the hooks 43, 44 on the first stage inner shroud 42. The seal plate 46 extending to the periphery is formed to insert into the interior of this inner seal plate groove.

The seal plate 46 inserted into the inner seal plate groove 83 of hook 44 is mounted so that the outer circumferential side (of seal plate 46) protrudes into the gaps 24, 25 on the outer radial side from the outer circumferential side of hook 44 on the first stage inner shroud 42. The seal plate 46 protruding into the gaps 24, 25 functions to lower the leak currents 27, 28 of the cooling air 9 flowing through these gaps 24, 25.

Figure 5:
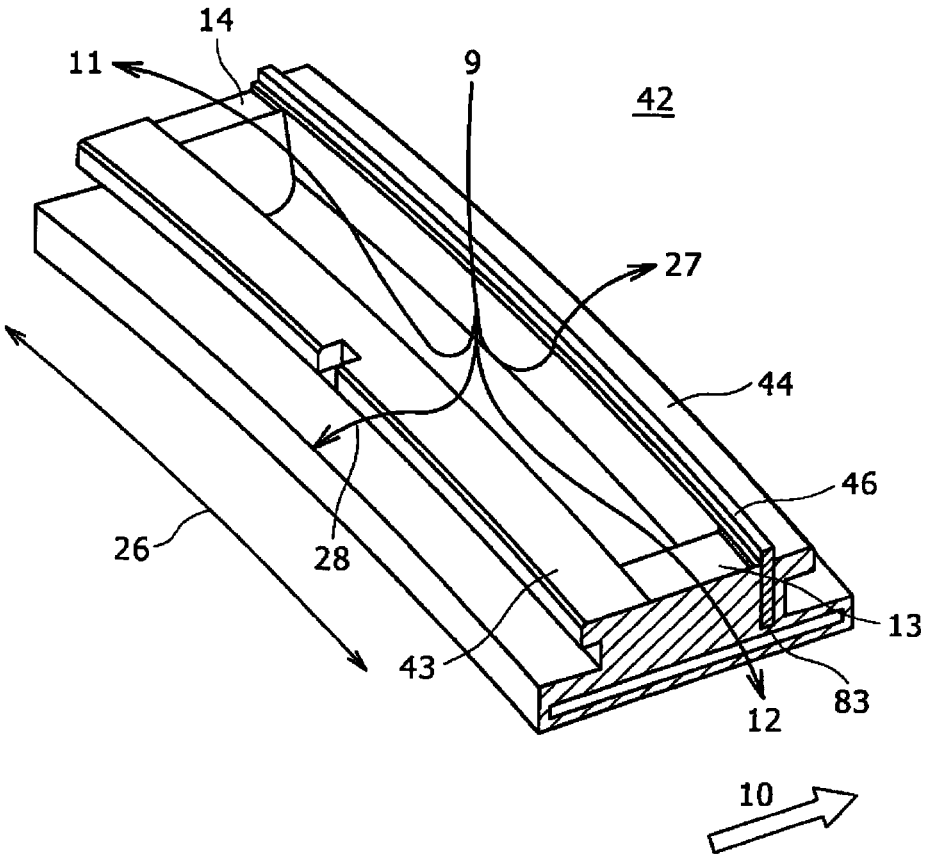
FIG. 5 is a perspective view showing the first stage inner shroud in the gas turbine shroud structure of the second embodiment.

FIG. 5 is a perspective view of the first stage inner shroud 42. The inner seal plate groove 83 is mounted in the hook 44. The seal plate 46 is inserted into the interior of the inner seal plate groove 83.

In the gas turbine shroud structure of this embodiment, the seal plate 46 suppresses the leak current 27 flowing through the gap 25 and so reduces the flow rate of the leak current 27. The cooling air 9 reaching the first stage inner shroud 42 is increased by an amount equivalent to the lowered leak current 27, heat damage to the applicable first stage inner shroud 42 is prevented by the drop in the temperature of the metal in the first stage inner shroud 42, and reliability is improved.

Maintaining a specific (fixed) quantity of cooling air 29 also signifies that the amount of cooling air 9 can be reduced by an amount equivalent to the reduction in the leak current 27. Lowering the amount of cooling air 9 in this case improves the gas turbine efficiency.

The temperature of the gas turbine path rises, the farther upstream of the arrow 10, so that the temperature of the metal in the first stage inner shroud 42 facing the turbine gas path also tends to rise the further upstream on the gas turbine path.

In the gas turbine shroud structure of this embodiment, there is no inner seal plate groove and seal plate in the hook 43 serving as the upstream side of hook 44 so that there is a large flow quantity with nothing to block the leak current 28. The present embodiment prevents heat damage by cooling the upstream side of the first stage inner shroud 42 via the leak current 28 to lower the temperature of the metal, and improves the reliability of the first stage inner shroud 42.

Also, installing the seal plate 46 and the inner seal plate groove 83 on the hook 44 functioning as the downstream side suppresses the flow of cooling air 9 in the leak current 27 flowing through the gap 25 and so improves the efficiency of the gas turbine by an amount equivalent to the reduction in the leak current 27.

Also among the gaps 24, 25 in the gas turbine shroud structure of this embodiment only the gap 25 is the section narrowed by the seal plate so that the frictional force when the hooks 43, 44 of first stage inner shroud 42 are inserted into each hook retainer groove 21 on the inner circumferential side of the first stage outer shroud 1 can be minimized and a worsening of assembly characteristics suppressed more than in the gas turbine shroud structure of the first embodiment.

Further, if assembly is difficult due to a large frictional force on the protruding section on the outer circumferential side of the seal plate 46, then the gap must be widened by machining the outer circumferential sides of the seal plate 46. However, there is only one seal plate 46 formed on the outer circumferential surface of the hook 44 of the first stage inner shroud 42 so that the section for machining is minimal and the machining proceeds faster by an equivalent amount and therefore the assembly characteristics are improved.

This embodiment of the present invention lowers the amount of cooling air leakage that is lost along the cooling air path during feeding of cooling air into the inner shroud from the one-piece outer shroud of the gas turbine and also suppresses a drop in the amount of cooling air that cools the inner shrouds. This embodiment therefore achieves a gas turbine shroud structure that definitely provides more reliable cooling of the inner shroud.

Third Embodiment

The third embodiment of the gas turbine shroud structure of the present invention is described next while referring to FIG. 6.

The gas turbine shroud structure of this embodiment is largely identical to the gas turbine shroud structure of the first embodiment shown in FIG. 1 through FIG. 3 so descriptions common to both embodiments are omitted and only the sections that differ from the first embodiment are described next.

Figure 6:
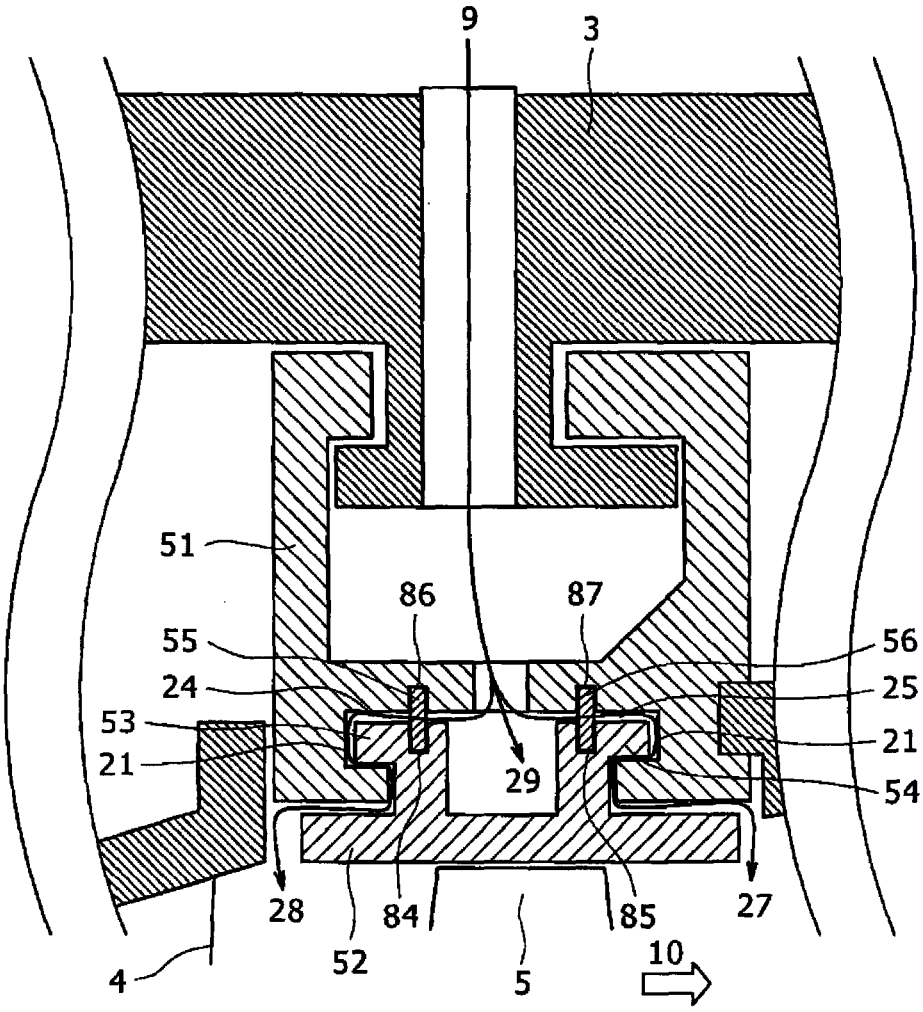
FIG. 6 is a fragmentary view showing the gas turbine shroud structure of a third embodiment of the present invention.

FIG. 6 is an enlarged view showing the periphery of the first stage inner shroud 52, and the one-piece first stage outer shroud 51 in the gas turbine shroud structure of the third embodiment.

On the outer circumferential side of the first stage inner shroud 52 assembled into the one-piece first stage outer shroud 51, the hooks 53, 54 are respectively installed extending horizontally so as to engage with each of the hook retainer grooves 21 formed on the inner circumferential side of the first stage outer shroud 51.

Multiple inner seal plate grooves 84, 85 are respectively formed along the periphery on the outer circumferential surface of the hooks 53, 54 of first stage inner shroud 52. Multiple outer seal plate grooves 86, 87 are also respectively formed along the periphery, at positions facing the inner seal plate grooves 84, 85 forming the inner circumferential surface of the one-piece first stage outer shroud 51.

A common seal plate 55 is formed for insertion in both the inner seal plate groove 84 formed on the outer circumferential surface of hook 53 on the first stage inner shroud 52, and the outer seal plate groove 86 formed on the inner circumferential surface of the one-piece first stage outer shroud 51.

Also, a common seal plate 56 is formed for insertion in both the inner seal plate groove 85 formed on the outer circumferential surface of the hook 54 on the first stage inner shroud 52, and the outer seal plate groove 87 formed on the inner circumferential surface of the one-piece first stage outer shroud 51.

The seal plates 55, 56 formed across the first stage inner shroud 52 and the first stage outer shroud 51, function to impede the cooling air 9 flow of the leak current 27, 28 flowing in the gaps 24, 25 formed between the hooks 53, 54 of the first stage inner shroud 52 and the first stage outer shroud 51.

In the gas turbine shroud structure of the present embodiment, the seal plates 55, 56 impede or drastically suppress the leak current 27, 28 flowing through the gaps 24, 25.

The seal plates 55, 56 are respectively inserted from the inner seal plate grooves 84, 85 formed on the outer surface of the hooks 53, 54 of first stage shroud 52 to the outer seal plate grooves 86, 87 formed on the inner surface of the first stage outer shroud 51 and so the effect rendered by this embodiment in lowering the leak current 27, 28 flow is larger than in the case of the gas turbine shroud structures of the first and second embodiments. A larger effect can also be anticipated in terms of improved reliability of the first stage inner shroud 52, and improved gas turbine efficiency resulting from a lower quantity of cooling air 9.

It may also be considered that the seal plates 55, 56 from the inner seal plate grooves 84, 85 to the outer seal plate grooves 86, 87 are formed only on the downstream-side hook 54 like the case of the gas turbine shroud structure of the second embodiment.

This embodiment of the present invention lowers the amount of cooling air leakage that is lost along the cooling air path during feeding of cooling air into the inner shroud from the one-piece outer shroud of the gas turbine and also suppresses a drop in the amount of cooling air that cools the inner shrouds. This embodiment therefore achieves a gas turbine shroud structure that definitely provides more reliable cooling of the inner shroud.

Fourth Embodiment

The fourth embodiment of the gas turbine shroud structure of the present invention is described next while referring to FIG. 7 and FIG. 8.

The gas turbine shroud structure of this embodiment is largely identical to the gas turbine shroud structure of the first embodiment shown in FIG. 1 through FIG. 3 so descriptions common to both embodiments are omitted and only the sections that differ from the first embodiment are described next.

Figure 7:
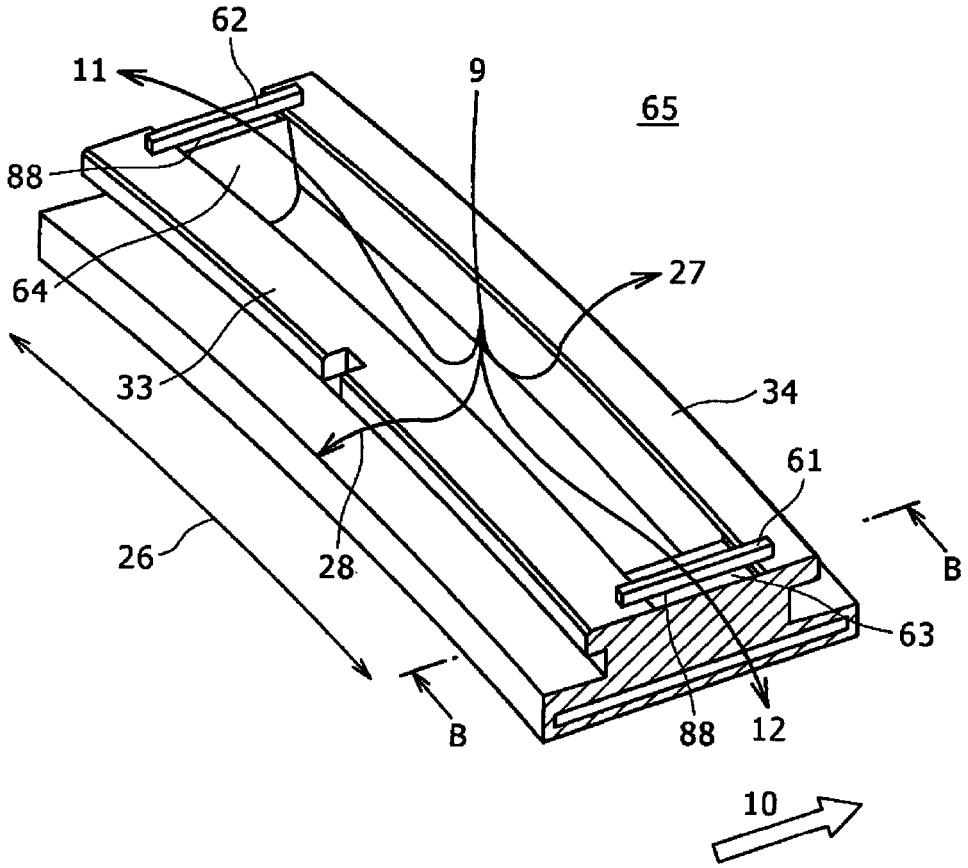
FIG. 7 is a perspective view showing the first stage inner shroud in the gas turbine shroud structure of a fourth embodiment of the present invention.

FIG. 7 is a perspective view showing the first stage inner shroud 65 as the gas turbine shroud structure of the fourth embodiment. The arrows 9, 11, 12, 27, 28 indicate the leakage flow of the cooling air 9 identical to that shown in FIG. 3.

The end sections of each first stage inner shrouds 66 segmented in plural pieces along the circumference contain the split surfaces 63, 64 facing the adjacent first stage inner shrouds 65. The seal plate grooves 88 are respectively formed in the axial direction of the turbine along the split surfaces 63, 64 and on the outer circumferential side of these split surfaces 63, 64. The seal plates 61, 62 respectively inserted inside the seal plate grooves 88. The seal plates 61, 62 are formed so that their outer circumferential sides protrude outwards towards the radius more than the outer circumferential surface of the split surfaces 63, 64.

Figure 8:
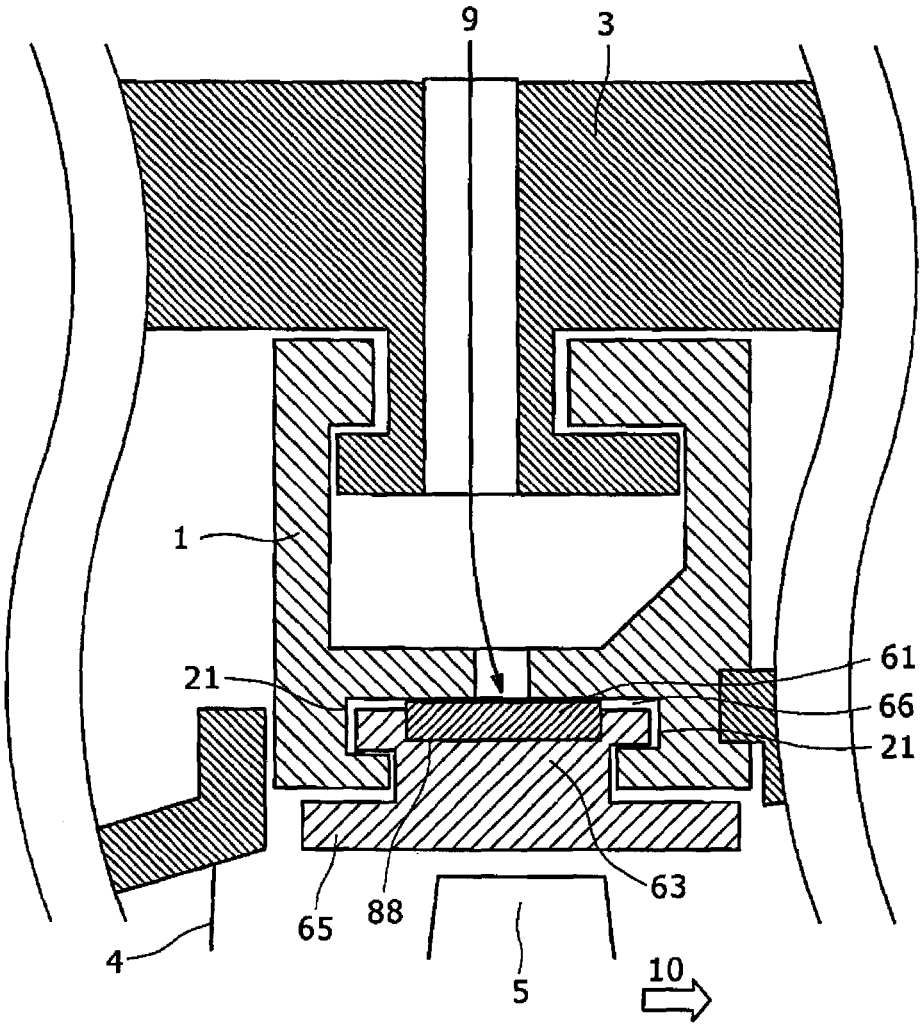
FIG. 8 is a cross sectional view of the section taken along lines B-B for the first stage inner shroud of the gas turbine of the fourth embodiment.

FIG. 8 is a cross sectional view showing the periphery of the first stage inner shroud 65, and the first stage outer shroud 1 at the position taken along lines B-B for the first stage inner shroud 65 in FIG. 7. A gap 66 is formed between the outer circumferential side of the split surface 63 of first stage inner shroud 65, and the inner circumferential side of the first stage outer shroud 1. The seal plate. 61 protrudes outward along the radius to the gap 66 as already described. Though not shown in FIG. 8, there is a gap 67 the same as the gap 66 between the inner circumferential side of the first stage outer shroud 1 and the outer circumferential side of the split surface 64 of the first stage inner shroud 65. The seal plate 62 protrudes outwards along the radius to the gap 67.

In the gas turbine shroud structure of this embodiment, the seal plates 61, 62 suppress the leak currents 11, 12 of the cooling air 9 shown in FIG. 7 that flow through the gaps 66, 67 and so reduce the flow rate of leak currents 11, 12. The cooling air 9 reaching the first stage inner shroud 65 is increased by an amount equivalent to the lowered leak current, heat damage to the applicable first stage inner shroud 65 is prevented by the drop in the temperature of the metal of the first stage inner shroud 65, and reliability of the applicable first stage inner shroud 65 is improved.

Maintaining a specific quantity of cooling air to the first stage inner shroud 65 also signifies that the amount of cooling air 9 can possibly be reduced by an amount equivalent to the reduction in the leak currents 11, 12. Lowering the amount of cooling air 9 in this case serves to improve the gas turbine efficiency.

This embodiment of the present invention lowers the amount of cooling air leakage that is lost along the cooling air path during feeding of cooling air into the inner shroud from the one-piece outer shroud of the gas turbine, and also suppresses a drop in the amount of cooling air that cools the inner shroud and therefore achieves a gas turbine shroud structure that definitely provides more reliable cooling of the inner shroud.

Fifth Embodiment

The fifth embodiment of the gas turbine shroud structure of the present invention is described next while referring to FIG. 9.

Figure 9:
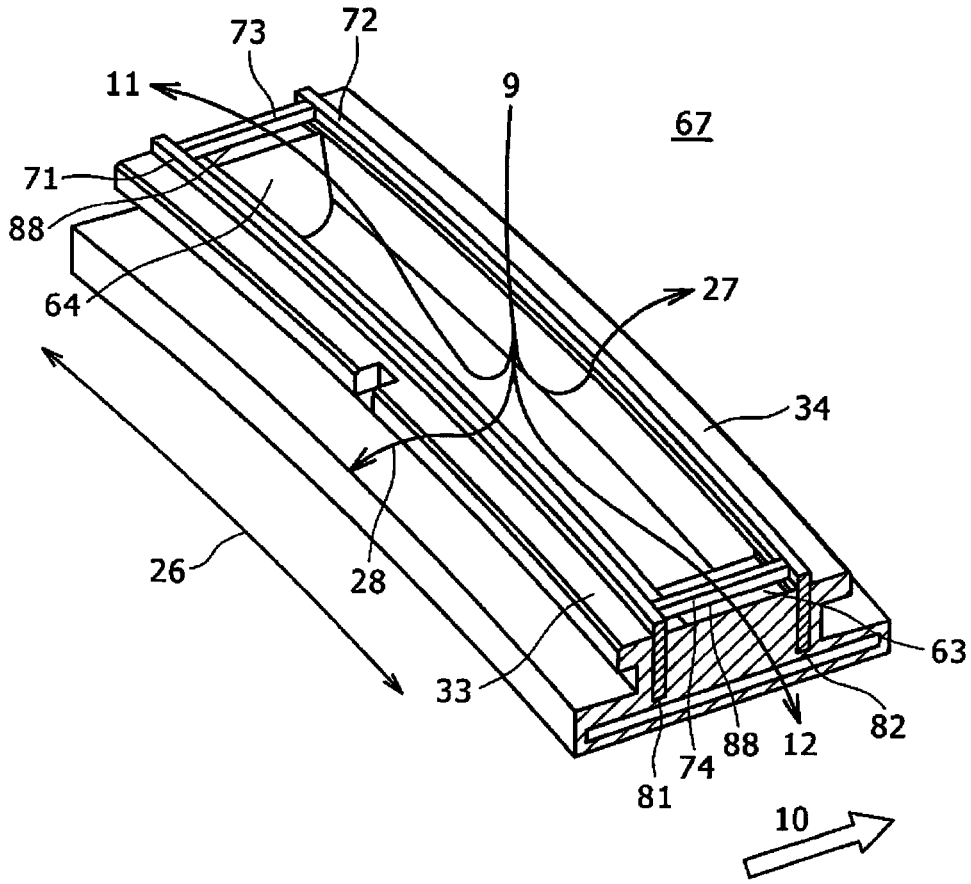
FIG. 9 is a perspective view showing the first stage inner shroud in the gas turbine shroud structure of a fifth embodiment of the present invention.

FIG. 9 is a perspective view showing the first stage inner shroud 67 serving as the gas turbine shroud structure of the fifth embodiment.

A first stage inner shroud 67 serving as the gas turbine shroud structure of this embodiment is a structure combining the gas turbine shroud structures of the first embodiment and the fourth embodiment.

In the first stage inner shroud 67 of the gas turbine shroud structure of this embodiment as shown in FIG. 9, the plural inner seal plate grooves 81, 82 are formed extending to the periphery on the outer circumferential side of the hooks 33, 34 of the first stage inner shroud 67. The seal plates 71, 72 are respectively inserted extending peripherally to the interior of these inner seal plate grooves 81, 82.

Further, the split surfaces 63, 64 facing the ends of the adjacent first stage inner shroud 67 are formed on the ends of each first stage inner shroud 67 segmented into plural pieces along the circumference. The seal plate grooves 88 are respectively formed in the axial direction of the turbine along these split surfaces 63, 64.

The seal plates 73, 74 are respectively inserted into the inside of the seal plate grooves 88 forming the outer circumferential side of the split surfaces 63, 64 of the first stage inner shroud 67. The seal plates 71, 72, 73, 74 are formed so that their outer circumferential sides protrude farther into the gaps outward along the radius (not shown in drawing) than the outer circumferential surface of the split surfaces 63, 64.

In the gas turbine shroud structure of this embodiment, the seal plates 71, 72, 73, 74 are mounted on the outer circumferential side of the first stage inner shroud 67 and can therefore suppress the entire flow of the leak currents 11, 12, 27, 28 of cooling air 9 flowing through the gaps between the first stage inner shroud 67 and the first stage outer shroud and therefore render the significant effects of lowering the amount of leakage, improving the reliability of the first stage inner shroud 67, and boosting the gas turbine efficiency by decreasing the quantity of cooling air 9.

The inner circumferential surface of the first stage outer shroud may also be formed by forming plural outer seal plate grooves along the periphery, and inserting the seal plates 71, 72 as common seal plates for both this outer seal plate groove and the inner seal plate groove 81 formed on the outer circumferential side of the first stage inner shroud 67, the same as in the gas turbine shroud structure of the third embodiment. The seal plates 71, 72 are in this case formed to a height that exceeds the gap dimensions. If the embodiment is comprised of common seal plates 71, 72 in this way, then the leak currents 11, 12, 27, 28 of cooling air 9 flowing through the gaps between the first stage inner shroud 67 and the first stage outer shroud can be suppressed even further, and the efficiency of the gas turbine improved to a higher level.

The embodiments of the present invention render a shroud structure for gas turbines capable of suppressing a drop in the amount of cooling air for cooling the inner shroud by reducing the amount of cooling air leakage that occurs along the cooling air path when feeding cooling air from the one-piece outer side shroud to the inner side shroud of the gas turbine and thus ensures more reliable cooling of the inner shroud.

The present invention is applicable to shroud structures in gas turbines.

What is claimed is:

1. A gas turbine shroud structure comprising:

a one-piece outer shroud to feed cooling air into internal sections of the gas turbine shroud structure, the outer shroud including a hook retainer groove formed continuously along the periphery on an inner circumferential side; and an inner shroud including a hook formed continuously along the periphery on an outer circumferential side and held on the inner circumferential side of the outer shroud by inserting the hook into the hook retainer groove of the outer shroud, and an inner circumferential side of the inner shroud fed with cooling air to the inside that passed by the outer shroud, facing gas path surfaces, wherein, in the gas turbine shroud structure including the inner shroud segmented into a plurality of inner shrouds along the periphery, the segmented inner shroud being all retained in an outer shroud retainer groove to form a ring-shaped inner shroud, hook retainer grooves of the outer shroud, and the inner shroud which hooks into the hook retainer grooves, are respectively mounted one each on an upstream side and a downstream side along an axial direction of a gas turbine;

a plurality of inner seal plate grooves are formed along the outer circumferential side of both an upstream side hook and a downstream side hook of the inner shroud;

a plurality of a first seal plates are respectively mounted in the plurality of inner seal plate grooves;

a split surface facing an edge of adjacent inner shrouds is formed on edges of each of the plural segmented inner shrouds;

a split surface seal plate groove is formed along a corresponding split surface on the outer circumferential side of the inner shroud; and a plurality of a second seal plates are inserted into the split surface seal plate grooves, wherein the first seal plates and the second seal plates are substantially disposed to contact each other so as to form a fence with the first seal plates and the second seal plates.

2. A gas turbine shroud structure comprising:

a one-piece outer shroud to feed cooling air into internal sections of the gas turbine shroud structure, the outer shroud including a hook retainer groove formed continuously along the periphery on an inner circumferential side; and an inner shroud including a hook formed continuously along the periphery on an outer circumferential side and held on the inner circumferential side of the outer shroud by inserting the hook into the hook retainer groove of the outer shroud, and an inner circumferential side of the inner shroud fed with cooling air to the inside that passed by the outer shroud, facing gas path surfaces, wherein, in the gas turbine shroud structure including the inner shroud segmented into a plurality of inner shrouds along the periphery, the segmented inner shroud being all retained in an outer shroud retainer groove to form a ring-shaped inner shroud, hook retainer grooves of the outer shroud, and the inner shroud which hooks into the hook retainer grooves, are respectively mounted one each on an upstream side and a downstream side along an axial direction of a gas turbine;

a plurality of inner seal plate grooves are formed along the outer circumferential side of both an upstream side hook and a downstream side hook of the inner shroud;

a plurality of a first seal plates are respectively mounted in the plurality of inner seal plate grooves;

a split surface facing an edge of adjacent inner shrouds is formed on edges of each of the plural segmented inner shrouds;

a split surface seal plate groove is formed along a corresponding split surface on the outer circumferential side of the inner shroud; and a plurality of a second seal plates are inserted into the split surface seal plate grooves;

wherein the first seal plates and the second seal plates are mounted so that a section of the first seal plates and the second seal plates protrudes into a gap between the hook of the inner shroud and the hook retainer mechanism of the outer shroud; and wherein the first seal plates and the second seal plates are substantially disposed to contact each other so as to form a fence with the first seal plates and the second seal plates.

* * * * *